US006997026B2

(12) United States Patent
Fischer

(10) Patent No.: US 6,997,026 B2
(45) Date of Patent: Feb. 14, 2006

(54) QUICK CHANGE METAL STUD TO HEMMED TRACK ROLL FORMING SYSTEM

(75) Inventor: Herbert J. Fischer, Imperial, MO (US)

(73) Assignee: Engel Industries, Inc., Bridgeton, MO (US)

( * ) Notice: Subject to any disclaimer, the term of this patent is extended or adjusted under 35 U.S.C. 154(b) by 91 days.

(21) Appl. No.: 10/248,033

(22) Filed: Dec. 12, 2002

(65) Prior Publication Data

US 2004/0112005 A1 Jun. 17, 2004

(51) Int. Cl.
*B21D 5/08* (2006.01)

(52) U.S. Cl. ..... 72/181; 72/226; 72/176; 52/749.1; 52/720.1

(58) Field of Classification Search ..... 52/745.1, 52/733.1, 737.1–737.6, 741.1, 749.1, 720.1; 72/180, 181, 129, 164, 176, 178, 226
See application file for complete search history.

(56) References Cited

U.S. PATENT DOCUMENTS

| | | | | | |
|---|---|---|---|---|---|
| 718,476 | A | * | 1/1903 | King et al. | 072/226 |
| 1,464,956 | A | * | 8/1923 | Smith et al. | 470/68 |
| 1,673,787 | A | * | 6/1928 | Frahm et al. | 72/178 |
| 1,732,415 | A | * | 10/1929 | Owston | 72/49 |
| 2,280,564 | A | * | 4/1942 | Wilson | 72/133 |
| 3,051,214 | A | * | 8/1962 | Rutten et al. | 72/12.1 |
| 3,184,947 | A | * | 5/1965 | Erskine et al. | 72/294 |
| 3,326,026 | A | * | 6/1967 | Guillot | 72/163 |
| 3,685,129 | A | * | 8/1972 | Jureit et al. | 144/353 |
| 3,696,655 | A | * | 10/1972 | Hinks et al. | 72/321 |
| 3,720,995 | A | * | 3/1973 | Brown et al. | 228/170 |
| 3,747,184 | A | * | 7/1973 | Zaiss et al. | 228/4.1 |
| 3,834,204 | A | * | 9/1974 | Ihle | 72/183 |
| 3,888,099 | A | * | 6/1975 | Allen | 72/129 |
| 4,064,727 | A | * | 12/1977 | Amano et al. | 72/179 |
| 4,130,206 | A | * | 12/1978 | Buccicone | 414/788.9 |
| 4,471,641 | A | * | 9/1984 | Mitchell | 72/132 |
| 4,549,422 | A | * | 10/1985 | Harrow | 72/131 |
| 4,704,890 | A | * | 11/1987 | Vrignaud | 72/428 |
| 4,716,754 | A | * | 1/1988 | Youngs | 72/178 |
| 4,811,587 | A | * | 3/1989 | Knudson | 72/181 |
| 4,939,919 | A | * | 7/1990 | Chezzi | 72/181 |
| 4,953,378 | A | * | 9/1990 | Wallis | 72/185 |

(Continued)

OTHER PUBLICATIONS

Tool and Manufacturing Engineers Handbook; Society of Manufacturing Engineers; p. 34-4; 4th edition.

(Continued)

*Primary Examiner*—Jeanette E. Chapman
(74) *Attorney, Agent, or Firm*—Blackwell Sanders Peper Martin LLP

(57) ABSTRACT

An apparatus and method for selectively forming metal stud and track members from sheet material, the apparatus including a stud forming assembly capable of transforming the sheet material into a stud member as the material exits the stud forming assembly, and a track forming assembly capable of receiving the stud member as it exists the stud forming assembly and thereafter transforming the stud member into a track member. The track forming assembly is selectively moveable between an operative position wherein the track forming assembly is coupled to the stud forming assembly to receive the stud member as it exits the stud forming assembly, and an inoperative position wherein the track forming assembly is positioned such that it cannot receive the stud member as it exits the stud forming assembly. The apparatus may also include punch and shear mechanisms for performing various operations on the sheet material.

16 Claims, 10 Drawing Sheets

U.S. PATENT DOCUMENTS

| | | | | | |
|---|---|---|---|---|---|
| 5,163,311 | A | | 11/1992 | McClain et al. | |
| 5,319,952 | A | * | 6/1994 | Cadney | 72/181 |
| 5,617,754 | A | * | 4/1997 | Senft et al. | 72/165 |
| 5,829,294 | A | * | 11/1998 | Bradbury et al. | 72/176 |
| 5,916,320 | A | * | 6/1999 | Stinnertz et al. | 72/214 |
| 5,970,764 | A | * | 10/1999 | Surina | 72/7.6 |
| 6,223,577 | B1 | * | 5/2001 | Ujc et al. | 72/181 |
| 6,345,524 | B1 | | 2/2002 | Fischer | |
| 6,813,919 | B1 | * | 11/2004 | Ellis | 72/7.1 |

OTHER PUBLICATIONS

Halmos, George T.; High Production Roll Forming; Society of Manufacturing Engineers; p. 52, 82; 1st Edition.

Fundamental and Advanced Roll Forming Tutorial—A Collection of Articles; Fabricators & Manufacturers Associate International; pp. A-E.

Steel Framing Components & Accessories; Drywall, Plaster, Curtain Wall and Load-Bearing Construction Catalog; 2002; pp. 1-8; Unimast, Inc.

*Roll Forming Machines*; Tool and Manufacturing Enginners Handbook Desk Edition; Chapter 34; p. 34-4; 4th Edition; Society of Manufacturing Engineers.

Halmos, George T.; *High Production Roll Forming*pp. 52, 82; 1st Edition; Society of Manufacturing Engineers.

Steeel Framing Components & Accessories Catalog; Unimast Incorporated Product Catalog; 2002; pp. 1-8, Unimast Incorporated.

*Fundamental and Advanced Roll Forming Tutorial-A Collection of Articles*, Fabrications and Manufacturers Roll Forming Conference; pp. A-E; Fabricators and Manufacturers Association International.

* cited by examiner

QUICK CHANGE METAL STUD TO HEMMED TRACK ROLL FORMING SYSTEM

BACKGROUND OF INVENTION

The present invention relates generally to roll forming machines and structural framing components made therefrom and, more particularly to a roll forming apparatus for fabricating metal studs and tracks for structural framing and other load-bearing construction systems, the present roll forming apparatus facilitating the fabrication of variable metal studs and tracks from a common sheet of coiled material with minimum changeover time.

Metal framing components and associated accessories are widely used in the construction industry for many different structural framing applications. Structural framing members include metal studs, metal joists and accompanying channel tracks designed for load-bearing construction applications. These metal framing members are typically made of light steel and come in several styles to meet various needs. Performance characteristics may vary depending upon the gauge (thickness), web dimension, flange and the specific style of the member itself. The key variation among metal stud styles is in the web dimension. For most applications, the flange is the bearing surface for cladding materials. It is also a key contributor to the load bearing capacity of the stud member.

Metal studs and joists are typically made with punched holes in the web dimension of the stud or joist for accommodating plumbing and electrical installation. The metal track members accompany all stud/joist designs and serve as channel runners and/or end caps at the top and bottom of any load bearing wall construction. These track members may also be combined with other members to form headers and other structural components for added strength. In a typical wall construction, the metal studs are placed within the track members at each opposite end thereof and are attached thereto in spaced apart relationship along the length of the track members in accordance with building code specifications.

Metal studs and tracks are typically fabricated from a roll forming process using a sheet of coiled material having one width dimension for fabricating the stud member and another sheet of coiled material having a different width dimension for fabricating the track member. FIGS. 1 and 2 illustrate a typical metal stud and metal track fabricated from a conventional roll forming process, the track member 10 illustrated in FIG. 1 having a slightly greater width or web dimension 12 as compared to the width or web dimension 22 of the stud member 20 illustrated in FIG. 2 for receiving the same therewithin. The track member 10 can be fabricated in a plurality of predetermined lengths to accommodate any particular application and typically includes a substantially flat bottom wall or web portion 12 and a pair of opposed upstanding side walls 14 forming a generally U-shaped channel track member as illustrated in FIG. 1. The stud member 20 is sized to fit within the track member 10 and typically includes a substantially flat wall or web portion 22, a pair of opposed side walls 24, and a pair of opposed flanges 26 as illustrated in FIG. 2. Like the track member 10, the stud member 20 can likewise be fabricated in a plurality of predetermined lengths to accommodate any particular application.

Because the stud member 20 includes inwardly projecting flanges 26, the sheet of coiled material utilized for forming the stud member is normally of greater width than the sheet of coiled material utilized to fabricate the track member 10. Because of this difference in coil width, the roll forming process must be stopped and the size of the coiled material must be changed when transitioning from fabricating metal stud members to fabricating metal track members, or vice versa. As a result, a typical manufacturing process would include fabricating a plurality of stud members and thereafter, stopping the roll forming machinery, removing the sheet of coiled material for fabricating the metal studs, inserting and feeding a new sheet of coiled material having the appropriate width for manufacturing the track members, making adjustments to the roll forming machinery to achieve a greater width or web dimension, removing or adding roll forming stations to accomplish or delete the roll forming of the stud flanges, and thereafter restarting the roll forming process so as to manufacture a plurality of track members. This changeover or transition from roll forming metal studs to roll forming track members is time consuming and labor intensive since the roll forming equipment must be changed and adjusted to achieve the end product, namely, inwardly extending flanges associated with the stud member, and a greater width or web dimension with no inwardly extending flanges associated with the track member. Often times, separate roll forming machinery is utilized to fabricate the studs and tracks. This is also expensive since dual equipment must be maintained. Additionally, construction industry workers must measure and position studs at the proper spaces within the track members before drilling and securing them in place. This process is likewise labor intensive and inefficient.

It is therefore desirable to design and implement a roll forming system which would facilitate a quick transition from fabricating metal stud members to fabricating corresponding metal track members from the same piece of equipment and from the same common sheet of material thereby eliminating the need to stock and manually change the sheet of coiled material during the manufacturing process and the need to maintain separate machinery or substantially manually reconfigure existing equipment. It is also desirable to design and implement a roll forming system which is programmable to punch a plurality of openings at predetermined spaced apart locations along the length of the web portion of the metal stud during the manufacturing process and which will shear the coiled material at a predetermined length to produce a plurality of metal studs all of the same predetermined length, or different lengths; it is desirable to design and implement a roll forming system which is programmable to punch a plurality of corresponding openings and tabs associated respectively with the stud members and track members for attaching the same to each other at predetermined locations along the length of each track member; it is desirable to improve the overall operation and efficiency of fabricating metal studs and corresponding track members and to substantially reduce the time during transition; and it is desirable to reduce the overall cost of such equipment.

Accordingly, the present invention is directed to overcoming one or more of the problems as set forth above.

SUMMARY OF INVENTION

In one aspect of the present invention there is disclosed a variable stud and track roll forming apparatus which includes a stud forming assembly and a track forming assembly, the track forming assembly being removably attachable or otherwise removably positionable adjacent the stud forming assembly so as to receive the stud member as it exits the stud forming assembly and to thereafter perform additional roll forming operations thereto to convert a metal stud member into a metal track member when desired. The stud forming assembly includes a typical roll forming assembly having a plurality of individual roll forming units or stations positioned and located so as to transform a sheet of coiled material into a standard metal stud member such as the stud member illustrated in FIG. 2. The track forming assembly likewise includes several individual roll forming units or stations positioned and located such that when the track forming assembly is positioned adjacent to the stud forming assembly, the inwardly extending flanges such as the flanges 26 illustrated in FIG. 2 associated with the metal stud member are hemmed or otherwise folded inwardly so as to transform the previously formed metal stud member into a metal track member. Importantly, this transformation occurs using the same common sheet of coiled material.

In a preferred embodiment, the track forming assembly is pivotally attachable to the stud forming assembly so as to be pivotally moveable between an operative track forming position and an inoperative stud forming position. The present apparatus also includes means for adjusting the web dimension of the track member when transitioning from fabricating a stud member to fabricating a track member and may include means for punching holes in the web of the stud member to accommodate plumbing and electrical installation as well as means for shearing the sheet of coiled material at predetermined intervals to form predetermined lengths of corresponding stud and track members. The present apparatus may likewise include means for forming cooperatively engageable means for fastening the stud members to the track members at predetermined locations along the length of the track member during a particular application, and it may include electronic control means for programmably controlling various functions and operations of the present apparatus.

Movement of the track forming assembly into and out of its operative position with respect to the stud forming assembly allows an operator to quickly change from fabricating metal stud members to fabricating metal track members without having to manually change the size of the coiled material being utilized and without labor intensive reconfiguration of the roll forming equipment. The present assemblies can be permanently mounted in a factory setting or they can be mounted on a trailer or other mobile unit for job site portability and versatility. The present invention allows the same sheet of coiled material to be used for fabricating both the metal stud members and the metal track members; it eliminates manual cutting and reduces material handling; it saves wasted material; it eliminates extensive reconfiguration of the roll forming equipment; and it saves time and money.

These and other aspects and advantages of the present invention will become apparent to those skilled in the art after considering the following detailed description in connection with the accompanying drawings.

BRIEF DESCRIPTION OF DRAWINGS

For a better understanding of the present invention, reference may be made to the accompanying drawings.

DETAILED DESCRIPTION

Figure 4:
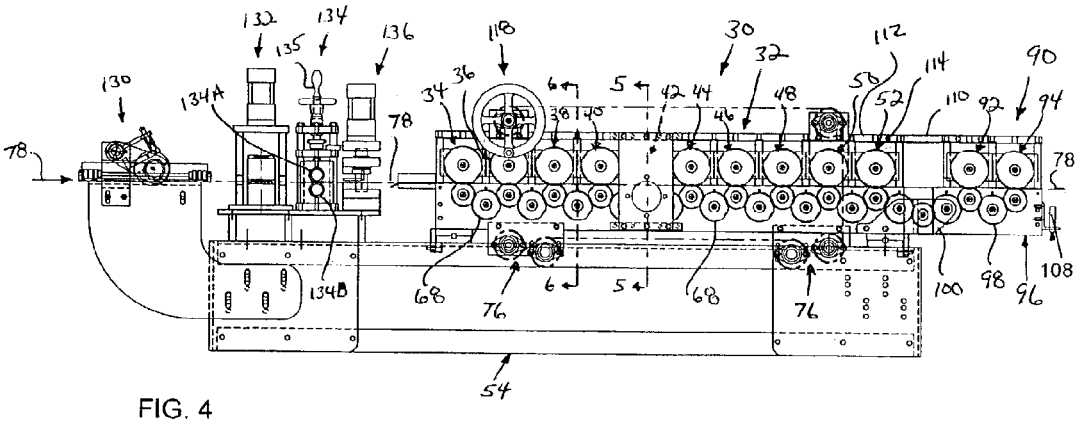
FIG. 4 is a side elevational view of the present apparatus similar to FIG. 3 showing the track forming assembly in its operative position.
Figure 3:
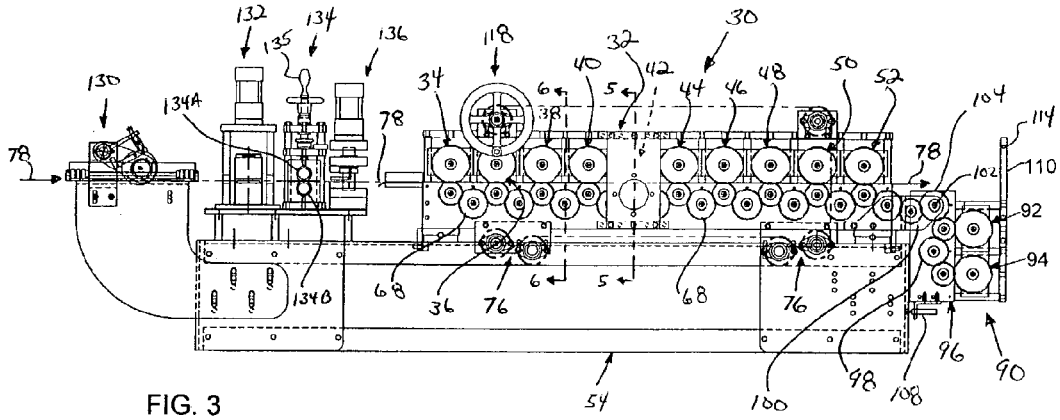
FIG. 3 is a side elevational view of the present apparatus showing the track forming assembly in its inoperative position.

Referring to FIGS. 3 and 4, there is shown one embodiment of the present metal stud/track roll forming system or apparatus 30 constructed according to the teachings of the present invention. The apparatus 30 includes a stud forming assembly generally designated 32, a track forming assembly generally designated 90, and appropriate support structure for operatively holding the assemblies 32 and 90, as well as other assemblies, as will be hereinafter further explained. In the embodiment illustrated in FIGS. 3 and 4, the stud forming assembly 32 includes a typical roll forming assembly having ten individual roll forming stations or units such as the stations 34–52 which are mounted on a support structure 54, the manner in which the roll forming units 34–52 are mounted in relationship to each other determining to a great extent the shape of the sheet metal material formed by assembly 32.

The construction and operation of each roll forming station 34–52 is well known in the art. For example, referring to FIG. 5 which is a cross-sectional view taken along line 5—5 of FIGS. 3 and 4, top and bottom spindle shafts 56 and 58 are rotatably coupled at each opposite end thereof in a conventional manner to appropriate support structure as illustrated. Appropriate journals and bearings 59 couple the top and bottom roll spindles 56 and 58 to the spindle housings or other support structure for rotation thereabout, the roll spindles 56 and 58 being driven in a conventional manner by a conventional motor or other appropriate power source 60 via appropriate gearing such as through the gear members 62 and 64. In the embodiment illustrated in FIG. 5, power source 60 is coupled to roll spindle 58 through known means for rotatably driving the lower spindle 58. Rotation of the lower spindle 58 also drives the upper spindle 56 through gear members 62 and 64.

Figure 5:
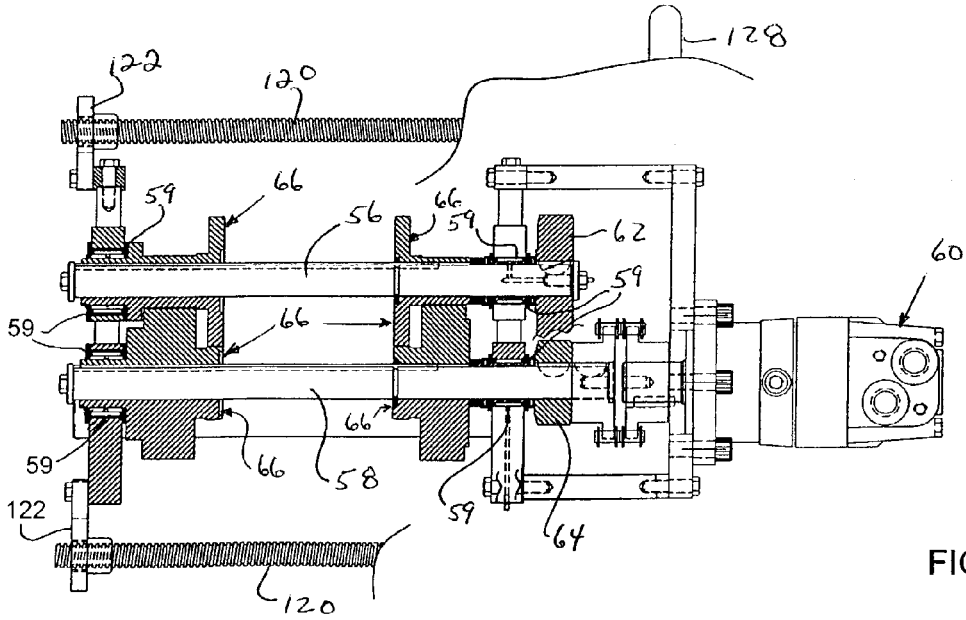
FIG. 5 is a cross-sectional view of the apparatus of FIGS. 3 and 4 taken along line 5—5.

Appropriate tooling such as the tooling 66 illustrated in FIG. 5 is likewise coupled to the upper and lower roll spindles 56 and 58 for accomplishing the specific roll forming application performed at that particular station, it being understood that each roll forming station will accomplish a specific roll forming task as the sheet of material continuously progresses through the various roll forming stations such as stations 34–52 illustrated in FIGS. 3 and 4. The selection of the particular roll forming equipment at each station is based upon the requirements of the end product to be formed. Material thickness and width, amount of forming and the material itself determines the roll shaft diameter. The depth of the section determines the roll diameter necessary to allow sufficient roll section around the roll shafts of the particular machine or station. Roll diameter range is also important so that proper pitch diameter relationships can be maintained depending upon the end product to be formed.

Figure 6:
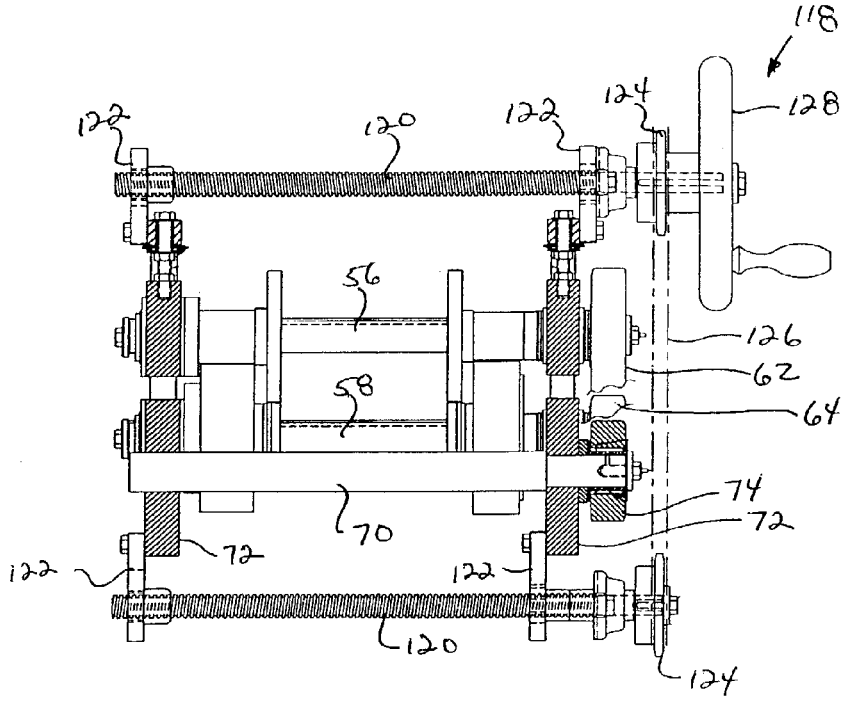
FIG. 6 is a cross-sectional view of the apparatus of FIGS. 3 and 4 taken along line 6—6.

FIG. 6 represents a cross-sectional view taken along line 6—6 of FIGS. 3 and 4 and illustrates the construction and operation of a typical idler assembly or guide roller such as the idler assemblies 68 associated with the stud forming assembly 32 and illustrated in FIGS. 3 and 4. Each idler assembly 68 includes an idler/guide shaft 70 which is similarly mounted through appropriate journals and bearings at each opposite end thereof to appropriate support structure such as the lower spindle housing 72 best illustrated in FIG. 6. Idler/guide shaft 70 is rotatably coupled to idler gear 74 which, in turn, is rotatably coupled to gear members 62 and 64 for rotation therewith in a conventional manner. It is recognized and anticipated that other roll forming configurations are well known in the art and can be utilized to accomplish the particular roll forming task associated with each roll forming station such as the stations 34–52 to achieve the particular end product desired. It is also recognized that appropriate adjustment and tensioning mechanisms such as the idler and drive screw mechanisms 76 which include an idler sprocket, a chain tightener and other appropriate mechanisms can be utilized to properly tension the idler assemblies for a specific roll forming application.

Figure 7:
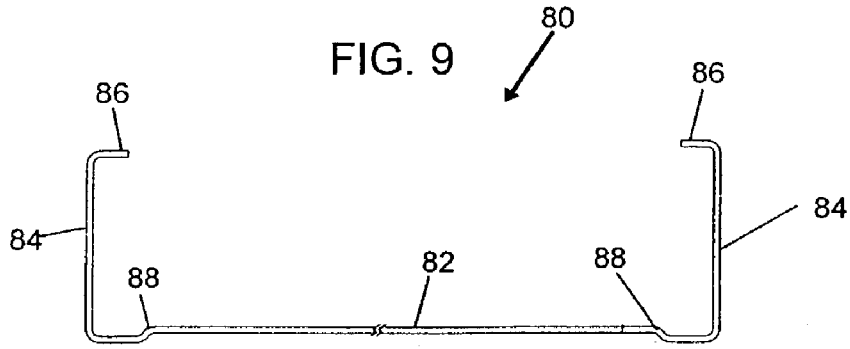
FIG. 7 is a cross-sectional view of a typical stud member formed by the stud forming assembly of the present apparatus.

Stud forming assembly 32 is constructed, configured and adjusted so as to produce a metal stud member such as the stud member 80 illustrated in FIG. 7 as a sheet of material such as a sheet of coiled material is fed through the stud forming assembly 32 starting at roll forming station 34 and ending at roll forming station 52 as illustrated in FIG. 3. In the particular embodiment illustrated in FIG. 3, as a sheet of coiled material is fed through roll forming assembly 32 along feedline 78 and progressively advanced through roll forming stations 34–52, the stud member 80 will be progressively formed and shaped. For example, roll forming stations 34–52 may be configured with appropriate tooling to accomplish the following forming process. As the sheet of coiled material passes through station 34, this station may form a pair of serrations or joggles in the web portion or side wall 82 of the stud member 80, this serration or joggle 88 adding structural integrity to the material and also allowing the material to be formed without side rolls. As the sheet of material progresses through station 36, the bending operation begins and as the sheet of material passes through stations 38–52, each station progressively increases the bending angles such that when the sheet of material exits station 52, a stud member 80 is formed having a side wall or web portion 82, upstanding wall portions 84, and inwardly extending flanges 86. In this regard, each roll forming station 34–52 would include appropriate tooling to accomplish the various tasks identified above.

It is also recognized and anticipated that, although a ten station roll forming assembly is illustrated in FIGS. 3 and 4, any number of roll forming stations may be utilized to achieve the particular size and shape of metal stud member desired. It is also recognized that many different styles and configurations of metal studs such as the stud member 80 can be produced using a roll forming process and the description and operation of stud forming assembly 32 is not limited to the specific construction illustrated in FIGS. 3 and 4, nor is it intended to be limited to the production of the specific metal stud member 80 illustrated in FIG. 7. Instead, the construction and operation of stud forming assembly 32 is intended to produce and achieve any metal stud configuration desired as the sheet of material exits the assembly 32.

The present apparatus 30 further includes a track forming assembly 90 which is removably positionable in substantial alignment with the stud forming assembly 32 to perform additional roll forming operations on the sheet of material as it progresses from the stud forming assembly 32 through the track forming assembly 90. In the particular embodiment illustrated in FIGS. 3 and 4, the track forming assembly 90 is illustrated as being pivotally rotatable from its inoperative position shown in FIG. 3 to its operative position shown in FIG. 4. In the particular embodiment illustrated, track forming assembly 90 includes two additional roll forming stations 92 and 94 which are mounted on an appropriate support structure 96. Roll forming stations 92 and 94 may be similar in overall construction and operation to roll forming stations 34–52 and each may include top and bottom spindle shafts similar to spindle shafts 56 and 58 (FIG. 5) as well as appropriate journals and bearings for rotatably coupling the roll shafts to the support structure 96 and to an appropriate gearing arrangement similar to the gear members 62 and 64 likewise illustrated in FIG. 5. An idler assembly 98 similar to the idler arrangement 70, 72 and 74 illustrated in FIG. 6 is likewise located between roll forming stations 92 and 94. Appropriate tooling similar to the tooling 66 illustrated in FIG. 5 is also associated with the top and bottom spindle shafts of stations 92 and 94 so as to perform additional roll forming operations on stud member 80 as will be hereinafter explained. The operation of roll forming stations 92 and 94 as well as idler assembly 98 are substantially similar to the operation of roll forming stations 34–52 and idler assemblies 68 associated with the stud forming assembly 32.

Figure 8:
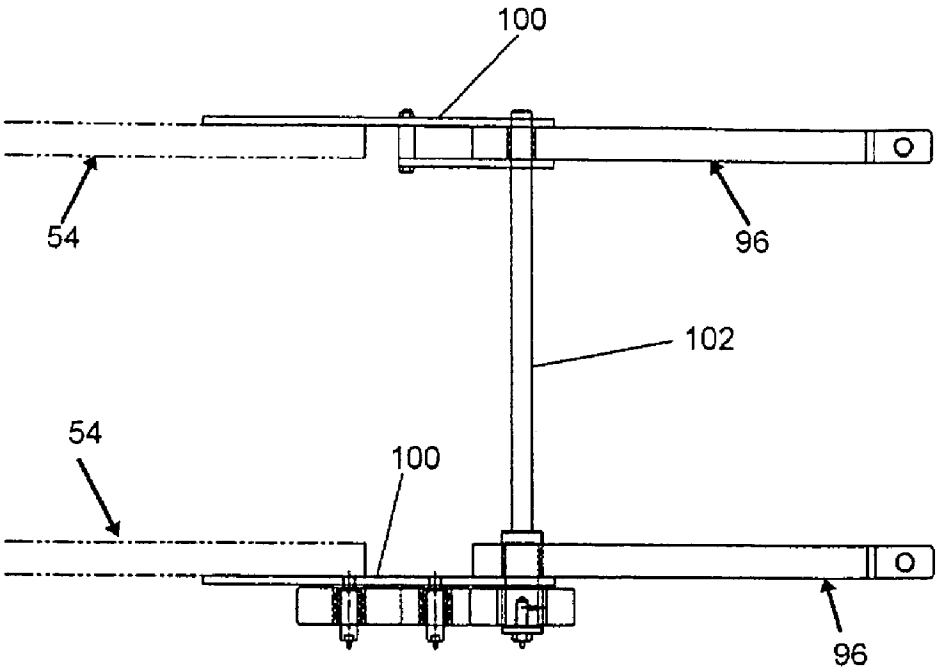
FIG. 8 is a partial top planform view of one embodiment of an attachment structure for pivotally mounting the track forming assembly to the support structure of the stud forming assembly.

The support structure 96 associated with track forming assembly 90 is pivotally attached to the support structure 54 of the stud forming assembly 32 via a pair of opposed bracket assemblies 100 and a pivot shaft arrangement 102 associated with idler member 104. As best illustrated in FIG. 8, opposed bracket members 100 have one end portion fixedly attached to portions of the support structure 54 associated with the stud forming assembly 32, whereas the opposite end portion of opposed bracket members 100 are pivotally attached to a portion of support structure 96 associated with track forming assembly 90 and to the pivot shaft 102. In this regard, as illustrated in the embodiment set forth in FIGS. 3 and 4, pivot shaft 102 may coincide with the spindle shaft associated with idler assembly 104, or pivot shaft 102 may be separate and apart from idler assembly 104. Other arrangements for pivotally attaching or coupling track forming assembly 90 in adjacent proximity to the stud forming assembly 32 is likewise recognized and anticipated.

As best shown in FIG. 3, when the track forming assembly 90 is positioned in its inoperative position, a shock absorber mechanism 108 is positioned and located on support frame assembly 96 so as to engage the support structure 54 as illustrated. This saves wear and tear on the track forming assembly 90 when in its inoperative position and when the stud forming assembly 32 is operable. In its inoperative position as illustrated in FIG. 3, the track forming assembly 90 has no effect on the stud member 80 (FIG. 7) as it exits the stud forming assembly 32.

As best illustrated in FIG. 4, when the track forming assembly 90 is pivotally rotated into its operative position in substantial alignment with the stud forming assembly 32, a pair of support members 110 associated with support structure 96 (FIGS. 3 and 4) are pivotally rotated into alignment with corresponding support members 112 associated with support structure 54 such that the members 110 and 112 either overlap with each other or are otherwise cooperatively positioned relative to each other such that the members 110 and 112 can be engaged and held in the operative position illustrated in FIG. 4 such as by passing holding pins or other fasteners (not shown) through cooperative openings associated with the members 110 and 112 such as the openings 114. Engagement of the support members 110 with support members 112 removably fix and stabilize the track forming assembly 90 in its operative position adjacent to the stud forming assembly 32 as illustrated in FIG. 4. It is recognized that still other attachment mechanisms for holding track forming assembly 90 in operative position adjacent to stud forming assembly 32 are likewise recognized and anticipated.

Figure 9:
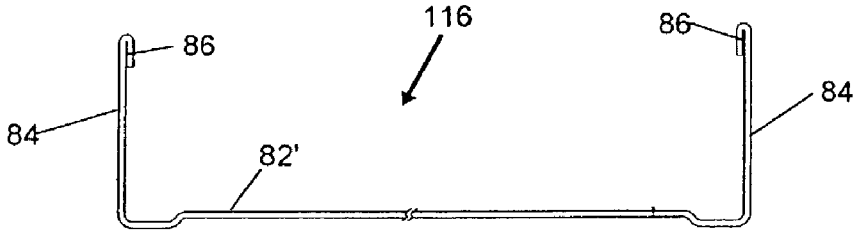
FIG. 9 is a cross-sectional view of a track member formed by the track forming assembly of the present apparatus.

When the track forming assembly 90 is selectively positioned into its operative position as illustrated in FIG. 4, roll forming stations 92 and 94 will perform additional roll forming operations upon the stud member 80 (FIG. 7) as stud member 80 exits the assembly 32 and is received by assembly 90. In this regard, roll stations 92 and 94 will includes appropriate roll forming tooling such that as the stud member 80 proceeds through stations 92 and 94, the inwardly extending flanges 86 will be hemmed or otherwise folded inwardly adjacent the wall portions 84 as illustrated in FIG. 9 so as to transform or otherwise convert the stud member 80 into track member 116 as illustrated in FIG. 9. It is recognized and anticipated that any number of additional roll forming stations may be associated with track forming assembly 90 to complete the transition from stud member 80 to track member 116 such that when the sheet of material exits the track forming assembly 90 along feedline 78, track member 116 (FIG. 9) will be fabricated. When an operator desires to return to the fabrication of metal stud members such as the stud members 80, the track forming assembly 90 is uncoupled from the stud forming assembly 32 and is pivotally rotated to its inoperative position as illustrated in FIG. 3. In its inoperative position, the stud member 80 exiting the stud forming assembly 32 is not received by the track forming assembly 90 and therefore no additional operations are performed on stud member 80.

Since the bottom wall or web dimension 82' of track member 116 is slightly greater than the web dimension 82 of stud member 80, the stud forming assembly 32 includes an adjustable screw drive mechanism 118 as best illustrated in FIG. 6 which allows an operator to adjustably change the width or web dimension 82' of track member 116 prior to starting the track forming operation. In the embodiment illustrated in FIG. 6, the screw drive mechanism 118 includes a pair of screw drives 120 which are respectively mounted to the upper and lower spindle housings via the mounting plates or brackets 122. The screw drives 120 are likewise rotatably coupled to respective sprocket members 124 which are rotatably coupled to a chain member 126 as illustrated in FIG. 6. The upper sprocket member 124 is likewise rotatably coupled through appropriate journals and bearings to a handwheel 128 which, when rotated, will adjustably drive the screw drives 120. Rotation of the handwheel 118 in the appropriate direction will allow the screw drives 120 to adjustably change the spacing of the upper and lower spindle housings relative to other portions of the stud forming assembly 32 thereby allowing the upper and lower roll forming housing assembly to be shifted or moved in its entirety axially along the roll spindles so as to change the width or web dimension 82' associated with track member 116. A detailed description of one embodiment of the structure involved with screw drive mechanism 118 to adjustably change the width or web dimension 82' of track member 116 is disclosed in U.S. Pat. No. 5,163,311 owned by the present assignee. It is recognized and anticipated that other mechanisms known in the art may be utilized to accomplish this change in width dimension associated with track member 116. In actuality, this width adjustment is normally in the range of approximately 1/16 of an inch. Although the web width 82' of track member 116 is generally expanded sufficiently so as to receive stud member 80 therewithin in a conventional manner, such expansion is not always mandatory. Once fabrication of the track members 116 is complete, the screw drive mechanism 118 may again be utilized to adjust the stud forming assembly 32 to achieve the appropriate width or web dimension 82 associated with fabricating stud member 80.

Although FIGS. 3 and 4 show the track forming assembly 90 pivotally rotatable about pivot shaft 102 (FIG. 8) in an up and down or vertical direction with the down position corresponding to the inoperative position and the up position corresponding to the operative position, it is recognized and anticipated that track forming assembly 90 could be pivotally rotated above stud forming assembly 32 such that its up position would correspond to an inoperative position and its down position would correspond to its operative position. It is also recognized and anticipated that track forming assembly 90 could be pivotally mounted to the support structure 54 so as to be pivotally moveable in a sideward or horizontal direction to either side of the stud forming assembly 32 such that its inoperative position would correspond to the track forming assembly 90 being pivotally moveable to one side of the stud forming assembly 32 and its operative position would again correspond to a position similar to that illustrated in FIG. 4 wherein the track forming assembly 90 is positioned to receive the stud member 80 as it exists the stud forming assembly 32. It is further recognized and anticipated that changing the pivotal mounting of the track forming assembly 90 relative to the stud forming assembly 32 may likewise precipitate corresponding changes in the support structures 54 and 96 associated with these assemblies in order to accomplish the specific pivotal movement desired. Changes in the locking or holding mechanism when track forming assembly 90 is positioned in its operative position relative to stud forming assembly 32 are likewise recognized and anticipated.

Still further, it is recognized and anticipated that track forming assembly 90 does not have to be pivotally mounted to the stud forming assembly 32, but instead, a wide variety of removably attachable means may be utilized to operatively position track forming assembly 90 adjacent stud forming assembly 32. For example, track forming assembly 90 may be housed separate and apart from the stud forming assembly 32 and each assembly 32 and 90 may include cooperatively engageable bracket means whereby track forming assembly 90 may be hand carried or otherwise maneuvered into its operative position with respect to stud forming assembly 32 and removably attached thereto when desired. In this embodiment, the track forming assembly 90 would be a secondary unit to the stud forming assembly and could be easily maneuverable and attached to the stud forming assembly 32 in its operative position when desired. Other removably attachable mechanisms for positioning track forming assembly 90 in operative position with stud forming assembly 32 such as bolting the assemblies together are likewise envisioned and anticipated.

Figure 1:
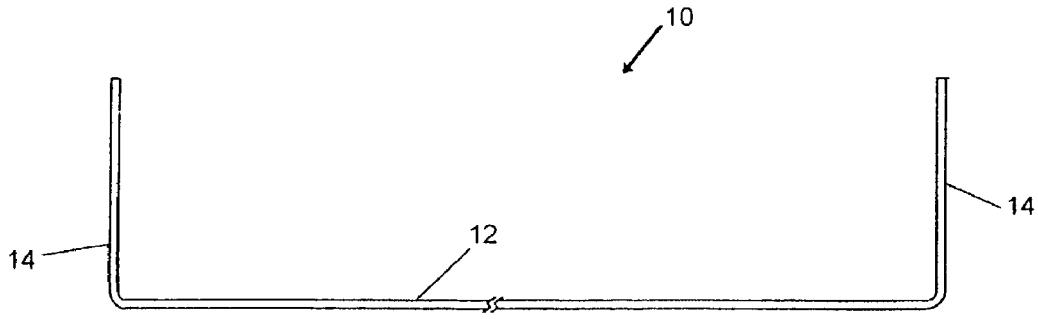
FIG. 1 is a cross-sectional view of a typical metal track member.
Figure 2:
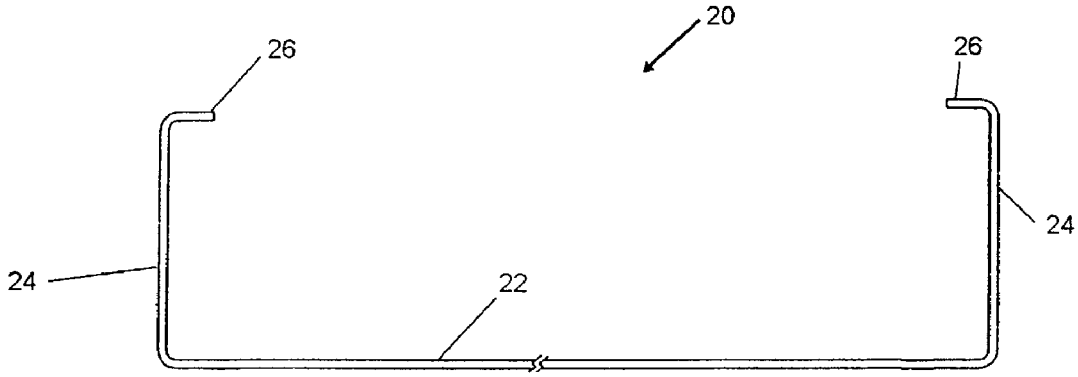
FIG. 2 is a cross sectional view of a typical metal stud member.

It is also recognized and anticipated that other adjustments to stud forming assembly 32 may be quickly and easily accomplished prior to beginning the roll forming process to fabricate any particular style or embodiment of a track member. For example, in the stud roll forming operation described above, the first station 34 may be raised or otherwise adjusted so as to eliminate the forming of the serration or joggle 88 associated with wall or web portion 82 of stud member 80 (FIG. 7). This adjustment would produce a substantially flat wall portion or web similar to the wall portion 12 associated with track member 10 illustrated in FIG. 1. Other adjustments to the various roll forming stations associated with stud forming assembly 32 may likewise be accomplished prior to beginning the fabrication of a particular track member. Importantly, however, the sheet of coiled material utilized to fabricate the stud members need not be changed in order to produce a corresponding track member as described above.

As best illustrated in FIGS. 3 and 4, the present apparatus 30 may likewise include a material infeed guide/encoder mechanism 130 which is designed to properly orient, clamp, guide and measure the sheet of material as it is fed through the apparatus 30, whether the sheet of material is in coiled form or some other form such as a flat sheet of material; a punch mechanism 132 for punching the appropriate holes or openings in the wall portion or web dimension 82 of stud member 80 for receiving appropriate plumbing or electrical installations therethrough and for performing other punch type operations to the sheet of material as will be hereinafter further explained; a pinch and feed roll assembly 134 for feeding the sheet of material into the stud forming assembly 32; and a shear mechanism 136 for cutting the stud and track members into predetermined lengths during the roll forming operation and for performing other shear type operations to the sheet of material as will be hereinafter further explained. These mechanisms are well known in the art and the punching, shearing and feed mechanisms 132, 134 and 136 can be either hydraulically or pneumatically operated. In this regard, in order to accommodate different thickness of sheet material, it is recognized that the upper and/or lower feed rollers 134A and 134B may be adjustably movable relative to each other such as through the hand crank 135 to control the spacing therebetween. Since the feed rollers 134A and 134B are powered via hydraulic and/or pneumatic means, line speed or feed speed of the material through the apparatus is controlled by feed mechanism 134 by controlling the flow rate of the hydraulic and/or pneumatic fluid to the feed rollers 134A and 134B.

Figure 10:
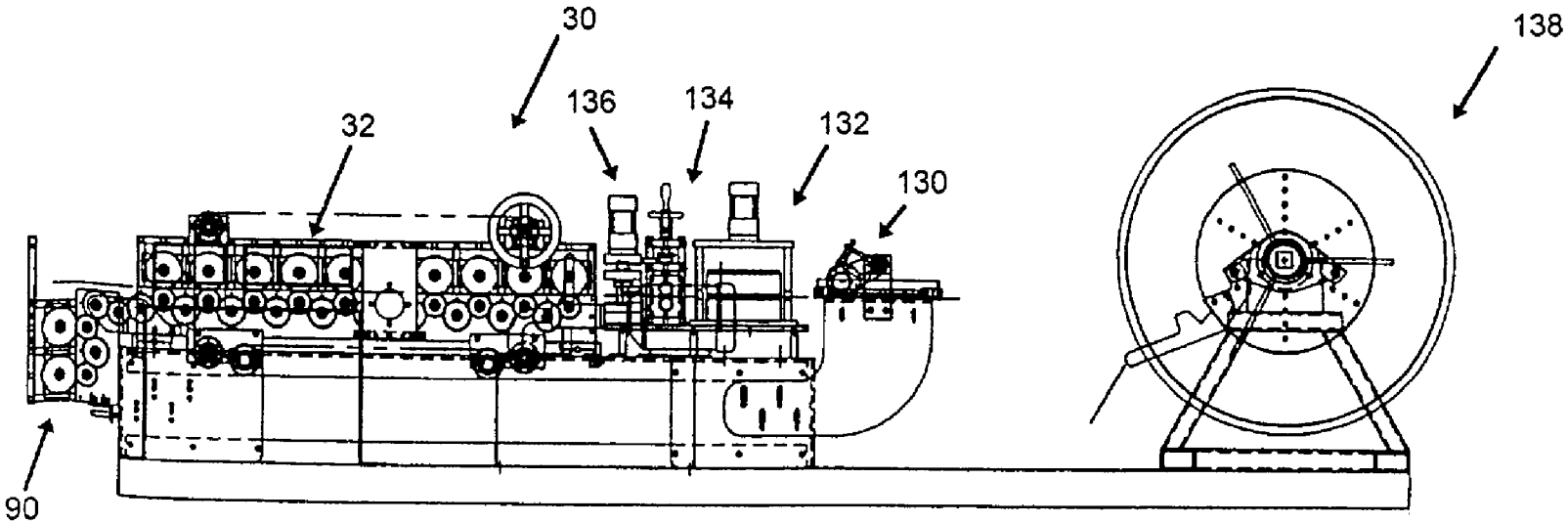
FIG. 10 is a side elevational view of the present apparatus showing a coil housing assembly for use with the present invention.

FIG. 10 illustrates the present apparatus 30 further including a coil housing assembly 138 positioned and located for holding a sheet of coiled material, the coil housing assembly 138 being constructed so as to allow one end portion of the sheet of coiled material to be fed into the guide mechanism 130 for progression through the punch mechanism 132, the feed mechanism 134, the shear mechanism 136, the stud forming assembly 42 and, when positioned in its operative position, the track forming assembly 90. Other arrangements and constructions of the guide mechanism 130, the punch mechanism 132, the feed mechanism 134, the shear mechanism 136 and the coil housing assembly 138 are likewise envisioned and anticipated.

Figure 11:
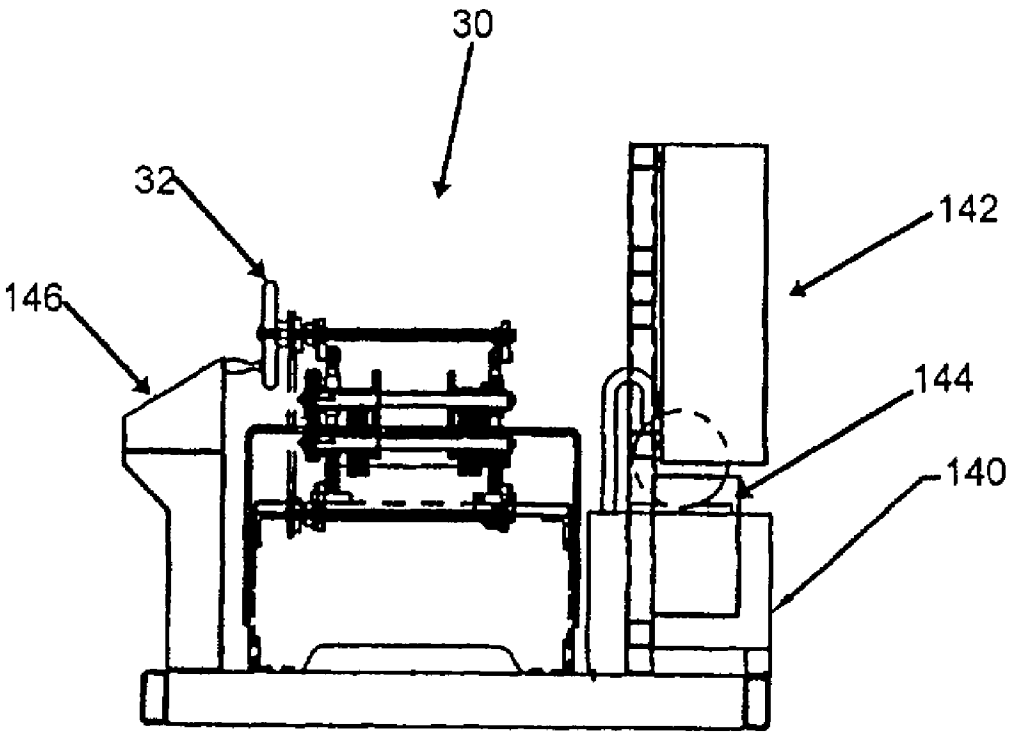
FIG. 11 is an end view of the present apparatus with the track forming assembly removed for illustrative purposes showing one embodiment for housing the power unit, electrical panel and control panel associated with the present apparatus.

FIG. 11 represents an end view of the present apparatus 30 with the track forming assembly 90 removed therefrom for illustrative purposes only, FIG. 11 illustrating one embodiment and one arrangement of an associated power unit 140, electrical panel 142, transformer 144, and operator control panel 146 for controlling the operation of the entire apparatus 30. The control panel 146 may be appropriately coupled to an electronic controller or other processing means located in electrical panel 142 or elsewhere for programmably controlling various functions and operations associated with the apparatus 30. For example, through various input features associated with control panel 146, an operator, through conventional controls and known programming features, can adjustably control the size, location and spacing of the holes or openings being punched by punch mechanism 132 along the length of the web portion 82 of stud member 80; an operator can programmably control the line speed or feed speed of the sheet of material being fed through the present apparatus 30 by feed mechanism 134; and an operator can programmably control the operation of the shear mechanism 136 so as to produce metal studs and metal tracks in predetermined lengths depending upon the particular applications involved. In this regard, the control panel 146 and the controller would be appropriately coupled to each other and to the punch mechanism 132, the feed mechanism 134 and the shear mechanism 136 to accomplish these programming features. The control panel 146 would also include appropriate operator input features for enabling an operator to enter operational parameters to control the punch, feed and shear mechanisms so as to form openings, tabs and other items in the sheet of material at predetermined locations therealong, to shear the sheet of material at predetermined locations therealong, and to control and adjust the line speed or feed speed of the sheet of material through the apparatus 30. Also, the infeed guide mechanism 130 may include an appropriate encoder or other device for sensing the length of material being fed through the present apparatus and such encoder or other equivalent device would likewise be coupled to the controller and to the shear mechanism 136 to again control the operation of the shear mechanism 136 to produce predetermined lengths of metal studs and metal tracks. It is recognized and anticipated that other computer controlled arrangements could be utilized to accomplish the programmable features desired.

The present apparatus 30, either in whole or in part, may be permanently mounted in a factory setting or, in its preferred form, may be mounted on a trailer or other mobile unit for job site portability and versatility. If the present apparatus 30 is trailer mounted, it can be easily positioned and maneuvered at the job site for easy manufacturing of metal studs and tracks at the work location. Because of its quick change capabilities and easy transition from metal studs to metal tracks and vice versa, metal studs and tracks can be custom fabricated at the job site to meet any application involved. Other portable mounting arrangements are likewise envisioned and anticipated.

Figure 12:
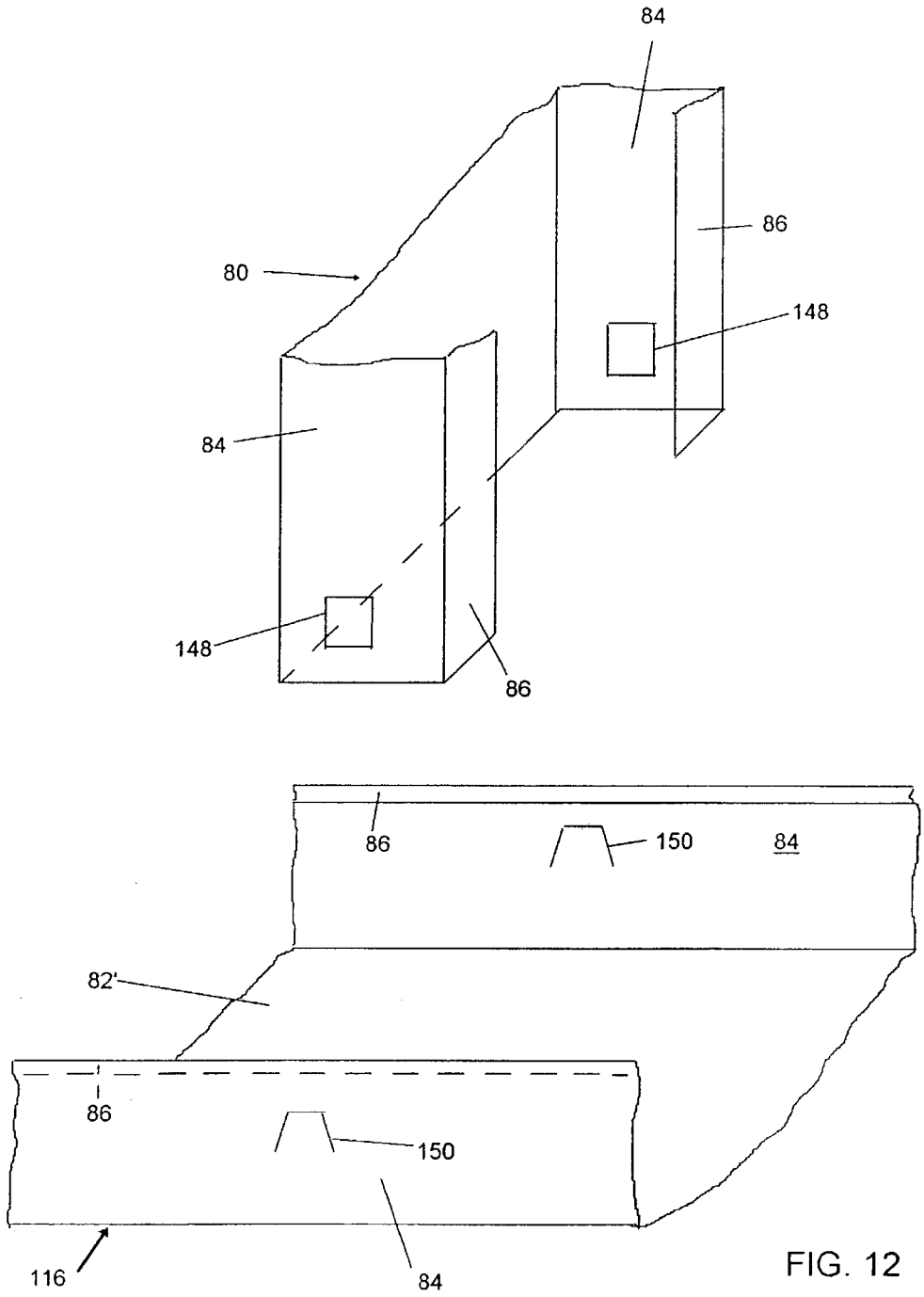
FIG. 12 is a partial exploded perspective view showing one embodiment of cooperatively engageable means fabricated by the present apparatus for fastening stud members at predetermined locations along the length of a track member.
Figure 13:
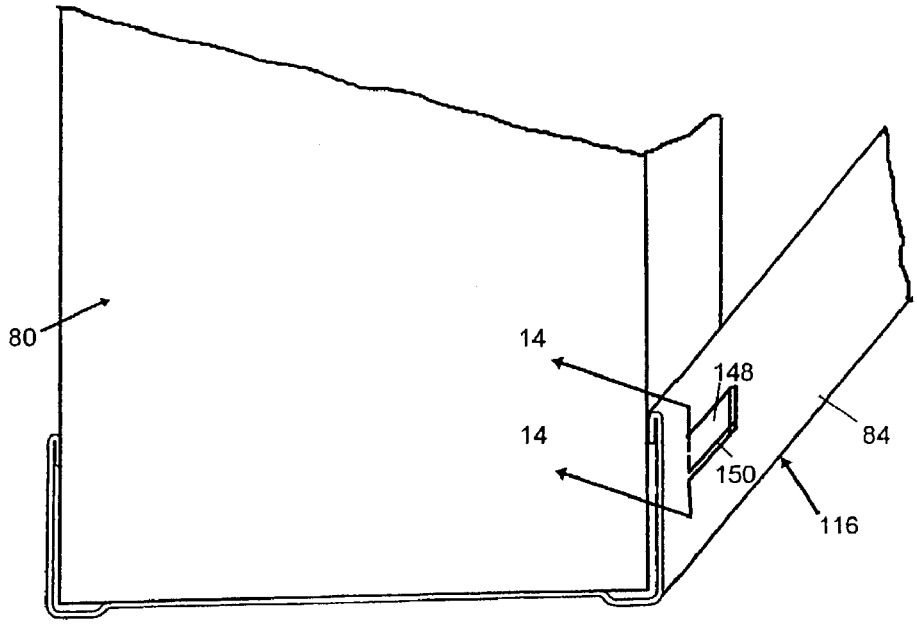
FIG. 13 is a perspective view showing a stud member fastened to a track member using the cooperatively engageable means illustrated in FIG. 12.
Figure 14:
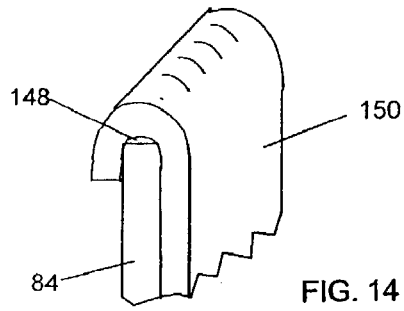
FIG. 14 is a partial cross-sectional view of the cooperatively engageable means illustrated in FIGS. 12 and 13 taken along line 14—14 of FIG. 13.

Due to the versatility of the present apparatus 30, the punch and shear mechanisms 132 and 136 may be utilized to form cooperatively engageable means for fastening the stud members to the track members at predetermined locations along the length of the corresponding track members. For example, as best illustrated in FIGS. 12–14, the shear mechanism 136 with appropriate tooling, dies and/or other reconfigurable modifications, may likewise be programmable to shear punch a pair of opposed openings 148 in the side walls 84 of the stud member 80 at predetermined spaced locations therealong such as at the respective opposite ends of a stud member of predetermined length such that when the stud member is cooperatively received within a corresponding top and bottom track member such as the track member 116 illustrated in FIGS. 12 and 13, the respective pairs of openings 148 would lie substantially in registration with a respective pair of bendable tab members 150 formed in the upstanding side walls 84 associated with the track member 116. In this regard, the punch mechanism 132 would likewise include appropriate tooling to form the bendable tabs 150 in the side walls 84 of the track member 116 and could be programmable through the operator control panel 146 to accomplish this task during the manufacturing process. When the stud member 80 is positioned within the track member 116 as illustrated in FIG. 13 such that the pair of tabs 150 mate with or otherwise lie in registration with the pair of openings 148, since the tab members 150 are either scored, perforated, or otherwise completely cut through along at least a substantial portion of the perimeter thereof, the tab members 150 can be bent or otherwise folded over into the respective openings 148 as best illustrated in FIG. 14. This attachment means eliminates screwing or otherwise fastening the stud members to the track members and likewise saves time, material and money.

Figure 15:
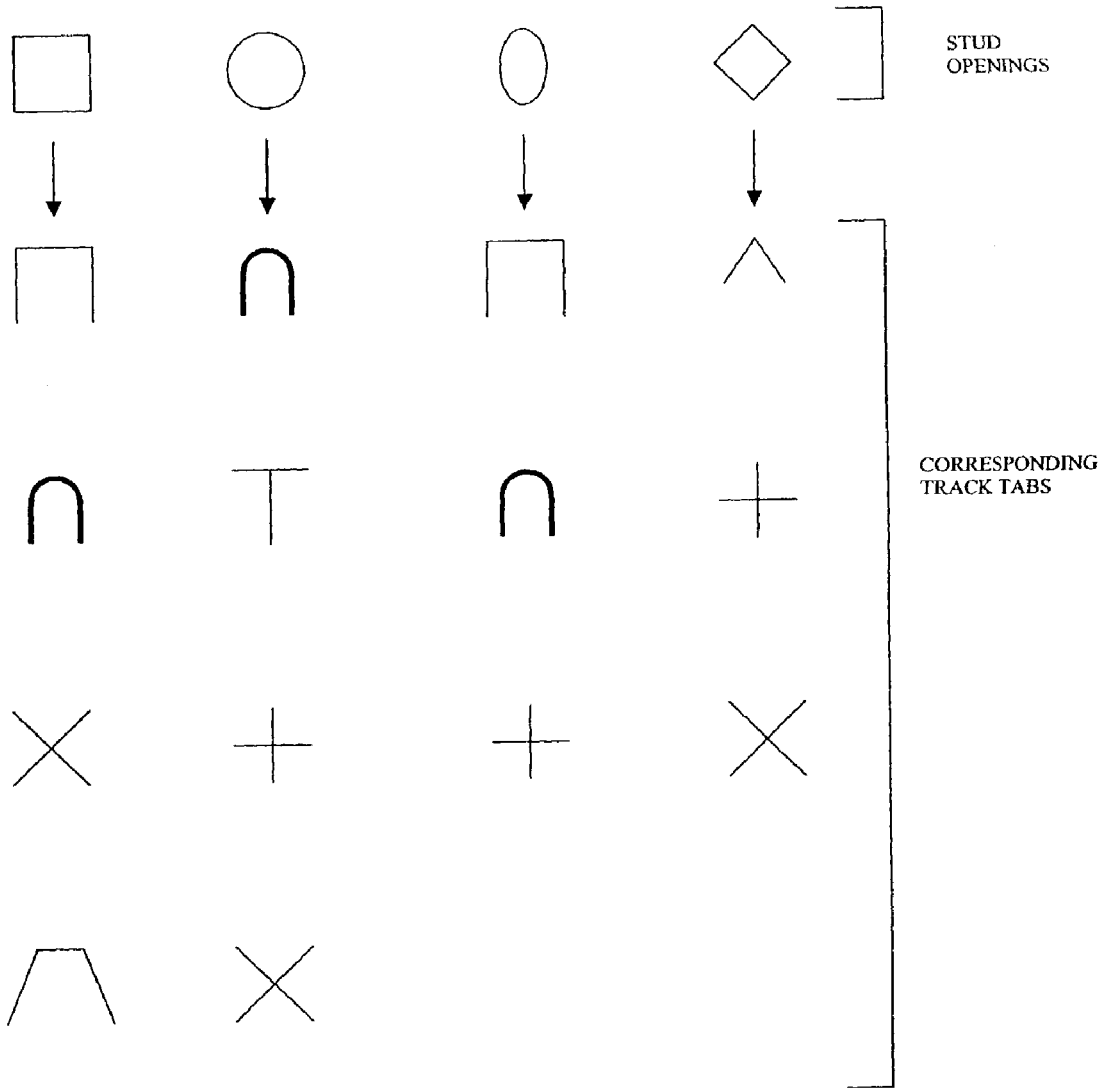
FIG. 15 is a chart showing some of the various stud openings and corresponding bendable track tabs which may comprise the cooperatively engageable means illustrated in FIGS. 12–14.

The bendable tabs 150 can be programmed at predetermined locations along the length of the track member, and multiple bendable tabs 150 may be pre-formed into a particular length of track member, the locations of the bendable tabs 150 being selected based upon applicable building code standards as to the appropriate spacing between the stud members for a particular wall construction. For example, the bendable tabs 150 may be located at 12 inch, 16 inch, or 18 inch centers, or any other building code requirement for placement of the stud members during a particular wall application. It is also recognized and anticipated that the size and shape of the openings 148 and the size and shape of the bendable tabs 150 may take on a wide variety of different shapes and configurations. In this regard, FIG. 15 illustrates some, but certainly not all, acceptable combinations of stud openings and bendable track tabs. With respect to the bendable tabs illustrated in FIG. 15 having the shape of an "X", "+", "T", and so forth, these configurations are scored or otherwise perforated such that portions of the track side wall 84 can be folded or bent inwardly through the corresponding stud opening 148 to accomplish the joinder. This bending action may be accomplished with a punch or other tool. Other corresponding opening and tab configurations are likewise envisioned and anticipated.

It is also recognized that the present apparatus 30 can be programmed to form the stud openings 148 during the stud forming process, and the bendable track tabs 150 during the track forming process. In this regard, additional adjustments and/or modifications may have to be made to the punch and shear mechanisms 132 and 136 to transition between forming the stud openings 148 and forming the bendable track tabs 150. All of these features, including the selection of the appropriate size and shape of both the stud openings 148 and the corresponding bendable track tabs 150 can be programmed and selected by an operator via known programming means including known hardware and software compatibility for accomplishing these additional programming functions. Again, all of these programmable features can be selected and initiated at control panel 146.

It is also recognized that the punch mechanism 132 may be utilized to merely punch a pair of pilot openings (not shown) in the side walls 84 of track members 116 at predetermined locations therealong so that typical sheet metal screws may be easily started for fastening the studs to the tracks in a conventional manner. In this application, the pilot openings would replace the stud openings 148 and the corresponding bendable track tabs 150.

As previously discussed, it is recognized and anticipated that although, in the embodiment of the present apparatus 30 illustrated in FIGS. 3 and 4, the stud forming assembly 32 includes ten roll forming stations and the track forming assembly 90 includes two roll forming stations, any number of roll forming stations may be associated with both assemblies 32 and 90 in order to accomplish the particular roll forming task desirable to achieve the end product. Also, although it is preferable that the present apparatus 30 include a punch mechanism 132, and a shear mechanism 136, it is recognized and anticipated that these functions may be performed after the actual forming of the stud member 80 and corresponding track member 116, and that the present apparatus may include just the stud forming assembly 32 and the track forming assembly 90 along with an appropriate material feed mechanism. It is also recognized and anticipated that the particular roll forming configuration associated with each roll forming station 34–52, 92 and 94 may be different from the particular roll forming configuration illustrated in FIGS. 5 and 6. Still further, although the track forming assembly 90 has been illustrated as being pivotally rotatable or tiltable about pivot shaft 102 and/or idler 104, it is recognized and anticipated that track forming assembly 90 may be pivotally rotatable about another location and that other pivot or rotational means may be utilized without departing from the spirit and scope of the present invention. It is also recognized that the track forming assembly 90 can be rotatably mounted to a structure other than support structure 54 and brackets 100 illustrated in FIGS. 3 and 4. Other modifications, changes and variations to the pivot feature of the present invention, including all equivalents thereof, are likewise contemplated.

Electronic control of the present apparatus 30 can be accomplished in a wide variety of different ways as briefly discussed above. For example, well known control systems can be implemented for adjusting the various parameters associated with the present apparatus 30 based upon the desired shape of the stud member or track member to be produced thereby. A typical control system would include electronic control means in the form of an electronic controller or other processing means which is capable of controlling various servo motors, actuators, and other control mechanisms for adjusting the various parameters associated with the apparatus 30 such as controlling the line feed or feed speed of the sheet of material being advanced through the apparatus 30; the size, location and spacing of the holes or openings being formed by either the punch mechanism 132 or the shear mechanism 136 along the length of the web portion 82 of stud member 80 as well as the size, location and spacing of the stud openings 148 and bendable tabs 150 associated with the stud and track wall portions 84; the forming of a pilot opening (not shown) in the wall portion 84 of track member 116; and the shearing of the sheet material to produce predetermined lengths of metal stud and tracks. Electronic controllers are commonly used in association with work machines for accomplishing various tasks. In this regard, a typical controller would include processing means such as a microcontroller or microprocessor associated electronic circuitry such as input/output circuitry, analog circuits and/or programmed logic arrays, as well as associated memory. Such a controller would be programmed to sense and recognize the appropriate signals indicative of the various conditions, states or other actuations of various mechanisms associated with the apparatus 30 such as signals indicative of the desired feed speed, desired size, location and spacing of the various holes and openings to be formed in the stud and track members, and the desired length of each track member and stud member. In this regard, input signals could be inputted to a typical controller via the input device or control panel 146. Input device 146 could take the form of a computer keyboard, a computer screen menu coupled with a keyboard for operatively selecting or inputting the desired parameters, or a computer touch screen menu where appropriate parameters can be inputted. Other operator selectable commands for selecting the desired parameters for input to a typical controller are likewise recognized and anticipated. Based upon the appropriate input signals, the controller would output appropriate signals to the appropriate control mechanisms to adjust the feed speed of the material, to select the appropriate size, shape, location and spacing of any holes or openings to be formed in the sheet material, to control the length of the metal studs and tracks fabricated, to start/stop the operation of the apparatus 30, and to control other features. In this regard, a controller would output a signal to the appropriate control mechanism to perform the appropriate task.

Based upon the parameters inputted to the controller, appropriate calibration tables, charts, maps and other data can be stored within the memory of the controller so as to determined the appropriate size and position of the various holes and openings to be formed in the sheet material, to determine the appropriate size, shape and location of the bendable tab 150 to mate with the selected stud opening 148, and so forth. The length of each track member or stud member can likewise be easily programmed into the controller and the fabrication process can be substantially automated including outputting a signal to the shear mechanism 136 based upon input from the infeed guide/encoder mechanism 130 to cut the sheet material at the appropriate length to produce predetermined lengths of metal studs and tracks. Still other control systems for accomplishing the forming of the various different styles of metal studs and tracks can be utilized without the departing from the spirit and scope of the present invention.

Use of the present apparatus 30 therefore affords a user or operator distinct advantages over the known prior art roll forming devices utilized to fabricate metal studs and tracks. As previously explained, use of the present apparatus greatly facilitates the changeover transition time from fabricating metal stud members to fabricating metal track members; it reduces material handling since the same sheet of coiled material utilized to fabricate the stud member can be utilized to fabricate the track member; it substantially reduces wasted material since the same sheet of coiled material is utilized to fabricate both the stud members and the track members; it substantially reduces extensive reconfiguration of the roll forming equipment; and it can be mounted on a trailer or other portable means to increase its flexibility and versatility, particularly at a job site. In addition, the programmable features of the present apparatus likewise improve its overall ease of operation, efficiency and versatility. The extensive measuring for proper stud positioning within a corresponding track member is now able to be automated and is now far more efficient.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims set forth below shall cover all such changes, modifications, variations and other uses and applications that do not depart from the spirit and scope of the present invention as described herein.

Other aspects, objects and advantages of the present invention can be obtained from a study of the drawings, the disclosure and the appended claims.

What is claimed is:

1. A single apparatus for selectively forming either a metal stud member or a metal track member from sheet material comprising:

a stud forming assembly capable of transforming the sheet material into a stud member as the material exits the stud forming assembly; and a track forming assembly capable of receiving the stud member as it exits the stud forming assembly and thereafter transforming the stud member into a track member;

said track forming assembly being coupled to said stud forming assembly adjacent one end portion thereof and being selectively pivotally moveable adjacent the one end portion of said stud forming assembly between an operative position wherein the track forming assembly is positioned in substantial alignment with said stud forming assembly to receive the stud member as it exits the stud forming assembly and an inoperative position wherein the track forming assembly is positioned such that it cannot receive the stud member as it exits the stud forming assembly, said apparatus forming a stud member when said track forming assembly is in its inoperative position and said apparatus forming a track member when said track forming assembly is in its operative position.

2. The apparatus defined in claim 1 including an attachment mechanism for holding the track forming assembly in its operative position relative to said stud forming assembly.

3. The apparatus defined in claim 1 wherein said track forming assembly is pivotally moveable in a vertical direction relative to said stud forming assembly.

4. The apparatus defined in claim 1 wherein said track forming assembly is pivotally moveable in a horizontal direction relative to the stud forming assembly.

5. The apparatus defined in claim 1 including a punch mechanism positioned upstream from the stud forming assembly, said punch mechanism being operative to perform punch type operations on the sheet material before the sheet material enters said stud forming assembly.

6. The apparatus defined in claim 5 wherein said punch mechanism is operative to form openings in the stud member for receiving plumbing and electrical installations therethrough.

7. The apparatus defined in claim 5 wherein said punch mechanism is operative to form openings in the track member at spaced locations along the length thereof.

8. The apparatus defined in claim 5 wherein said punch mechanism is operative to form bendable tab members in the track member at spaced locations along the length thereof.

9. The apparatus defined in claim 1 including a shear mechanism positioned upstream from said stud forming assembly, said shear mechanism being operative to perform shearing type operations on the sheet material before the sheet material enters said stud forming assembly.

10. The apparatus defined in claim 9 wherein said shear mechanism is operative to shear the sheet material at predetermined locations therealong so as to form stud members or track members of predetermined length.

11. The apparatus defined in claim 9 wherein said shear mechanism is operative to form openings in the stud member.

12. The apparatus defined in claim 1 including a feed mechanism positioned upstream from said stud forming assembly for feeding the sheet material into said stud forming assembly.

13. The apparatus defined in claim 1 wherein said stud forming assembly includes an adjustment mechanism for increasing the width of the track member as compared to the width of the stud member.

14. The apparatus defined in claim 1 wherein said stud forming assembly and said track forming assembly are mounted on a portable unit for use at a job site.

15. The apparatus defined in claim 1 including a coil housing assembly positioned upstream from said stud forming assembly for receiving and holding a sheet of coiled material.

16. The apparatus defined in claim 1 wherein the stud member which exits the stud forming assembly includes a pair of opposed side walls, each side wall including a flange portion extending inwardly therefrom, said track forming assembly folding the flanges of the stud member inwardly adjacent the side walls thereof to form the track member when in its operative position.

* * * * *